US010465487B2

(12) United States Patent
Robottom et al.

(10) Patent No.: US 10,465,487 B2
(45) Date of Patent: Nov. 5, 2019

(54) OUTER CASING STRING AND METHOD OF INSTALLING SAME

(71) Applicant: Cameron International Corporation, Houston, TX (US)

(72) Inventors: Gavin Paul Robottom, Leeds (GB); Edward T. Thornburrow, Bradford (GB); Nigel Hogg, Aberdeen (GB)

(73) Assignee: Cameron International Corporation, Houston, TX (US)

( * ) Notice: Subject to any disclaimer, the term of this patent is extended or adjusted under 35 U.S.C. 154(b) by 303 days.

(21) Appl. No.: 15/441,490

(22) Filed: Feb. 24, 2017

(65) Prior Publication Data

US 2017/0183941 A1 Jun. 29, 2017

Related U.S. Application Data

(63) Continuation of application No. 12/840,470, filed on Jul. 21, 2010, now Pat. No. 9,631,451.

(51) Int. Cl.

| | |
|---|---|
| ***E21B 43/10*** | (2006.01) |
| ***E21B 33/04*** | (2006.01) |
| ***E21B 17/08*** | (2006.01) |

(52) U.S. Cl.

CPC ..... *E21B 43/10* (2013.01); *E21B 17/08* (2013.01); *E21B 33/04* (2013.01); *E21B 33/0415* (2013.01); *E21B 43/101* (2013.01)

(58) Field of Classification Search

CPC .... E21B 43/10; E21B 43/101; E21B 33/0415; E21B 17/08; E21B 33/04

See application file for complete search history.

(56) References Cited

U.S. PATENT DOCUMENTS

| | | | | |
|---|---|---|---|---|
| 4,291,765 A | | 9/1981 | Gilchrist et al. | |
| 4,407,530 A | * | 10/1983 | Fowler | E21B 33/04 285/123.12 |
| 4,519,633 A | | 5/1985 | Nichols | |
| 4,550,782 A | * | 11/1985 | Lawson | E21B 33/043 166/382 |
| 4,569,404 A | * | 2/1986 | Milberger | E21B 33/043 166/208 |

(Continued)

OTHER PUBLICATIONS

International Search Report and Written Opinion of PCT Application No. PCT/US2011/037716 dated Feb. 9, 2012: pp. 1-8.

*Primary Examiner* — Blake E Michener

(74) *Attorney, Agent, or Firm* — Chamberlain Hrdlicka

(57) ABSTRACT

An outer casing string, including a surface casing head, and associated installation method. In some embodiments, the surface casing head includes an outer tubular member insertable through a diverter of an installed conductor system, an inner tubular member at least partially disposed within and moveable relative to the outer tubular member, and a sleeve ring rotatably coupled to the inner tubular. The outer tubular member has an annular recess. The sleeve ring includes a snap ring that is displaceable between an extended position and a retracted position. In the extended position, at least a portion of the snap ring is received within the annular recess, and the outer tubular member is axially immovable relative to the inner tubular member. In the retracted position, no portion of the snap ring is received within the annular recess, and the outer tubular member is axially moveable relative to the inner tubular member.

17 Claims, 14 Drawing Sheets

(56) References Cited

U.S. PATENT DOCUMENTS 4,653,589 A * 3/1987 Alandy ..... E21B 33/043 166/208
4,770,249 A * 9/1988 Courtney ..... E21B 33/03 166/379
4,938,289 A 7/1990 van Bilderbeek
5,524,710 A 6/1996 Shinn
6,516,887 B2 2/2003 Nguyen et al.
6,571,877 B1 6/2003 van Bilderbeek
6,598,673 B1 7/2003 Hosie et al.
7,159,663 B2 * 1/2007 McGuire ..... E21B 33/038 166/368
7,779,921 B2 * 8/2010 Cain ..... E21B 33/03 166/379
2002/0062964 A1 * 5/2002 Allen ..... E21B 17/1007 166/312
2002/0100596 A1 8/2002 Nguyen et al.
2002/0170721 A1 11/2002 June
2005/0082066 A1 * 4/2005 McGuire ..... E21B 33/038 166/379
2005/0167095 A1 8/2005 Nguyen
2005/0252653 A1 11/2005 Vanderford et al.
2007/0034382 A1 2/2007 van Bilderbeek
2007/0107910 A1 * 5/2007 McGuire ..... E21B 17/1007 166/379
2009/0032241 A1 * 2/2009 Allen ..... E21B 33/03 166/72
2009/0107685 A1 * 4/2009 Cain ..... E21B 33/03 166/379
2011/0048726 A1 3/2011 Aames et al.
2011/0253389 A1 10/2011 Nguyen
2012/0018171 A1 1/2012 Robottom et al.
2015/0204154 A1 * 7/2015 McClinton ..... E21B 33/03 166/379

* cited by examiner

OUTER CASING STRING AND METHOD OF INSTALLING SAME

BACKGROUND

The disclosure relates to an outer casing string and associated method of installation. More particularly, the disclosure relates to a surface casing head that may be run-in through a rotary table and a diverter for installation.

During construction of a wellbore, casing is typically cemented in place to stabilize the wellbore and to prevent the surrounding formation from caving in, and to isolate different regions of the formation. The casing includes a number of individual casing strings installed in a telescoping fashion, including a conductor, an outer casing string, an intermediate casing string, and a production casing string. The outer casing string is installed within the conductor before the wellhead is attached, and supports, at least in part, the remaining casing strings suspended therein. The outer casing string typically includes a surface casing head and an outer casing suspended there from.

A cross-sectional view of a conventional surface casing head is depicted in FIG. 1. As shown, the surface casing head 10 includes a casing head body 15, an inner barrel 20, a lock sleeve 25, an upper packing nut 30, and a lower packing nut 35. The casing head body 15 has a flange 40 at one end that enables coupling of a blowout preventer (BOP) to the surface casing head 10 after installation. Lock sleeve 25 is connected to the inner barrel 20 via a thread with a portion of the casing head body 15 disposed there between. Packing nuts 30, 35 are coupled to the lock sleeve 25 at the upper and lower ends, respectively, of lock sleeve 25. The outer casing, although not shown, is connected to and suspended from the inner barrel 20.

Installation of the surface casing head 10 into the conductor is complex for a number of reasons. Casing head body 15, in particular flange 40, is too large to pass through many conventional rotary tables. Consequently, during installation, the surface casing head 10 must be lowered over the edge of a rig, rather than through a rotary table. This involves moving the surface casing head 10 out of line with the well bore and then repositioning the surface casing head 10 back in line before it can be installed into the conductor. Likewise, flange 40 is too large to pass through many conventional diverters typically installed on the conductor. As a result, the diverter must be removed, surface casing head 10 installed, and the diverter reinstalled. This installation methodology requires multiple trips, and thus is time consuming and costly.

Installation of surface casing head 10 also requires significant manual handling and poses risks to the safety of the individuals involved. After landing an intermediate casing hanger (not shown) within surface casing head 10, packing nuts 30, 35 are manually decoupled from lock sleeve 25. Hydraulic fluid is then injected through a port 45 in lock sleeve 25, causing casing head body 15 to translate axially upward relative to inner barrel 20 to engage the intermediate casing hanger. Once surface casing head 10 is properly landed on the intermediate casing hanger, lock sleeve 25 is manually rotated about inner barrel 20 and moved axially upward to again engage casing head body 15. Movement of lock sleeve 25 in this manner is difficult because the annular space between lock sleeve 25, inner barrel 20, and casing head body 15 is pressurized. After lock sleeve 25 is repositioned in engagement with casing head body 15, packing nuts 30, 35 are manually reinstalled. Movement of lock sleeve 25 about inner barrel 20 to reengage casing head body 15 and subsequent coupling of packing nuts 30, 35 to lock sleeve 25 pose risks to the safety of the individuals involved because surface casing head 10 remains pressurized.

Accordingly, there is a need for a surface casing head and associated method of installation that enables run-in through conventional rotary tables and diverters and requires minimal manual handling, particularly when the surface casing head is pressurized.

SUMMARY OF THE DISCLOSURE

An outer casing string, including a surface casing head, and associated installation method are disclosed. In some embodiments, the surface casing head includes an outer tubular member insertable through a diverter of an installed conductor system, an inner tubular member at least partially disposed within and moveable relative to the outer tubular member, and a sleeve ring rotatably coupled to the inner tubular. The outer tubular member has an annular recess. The sleeve ring includes a snap ring that is displaceable between an extended position and a retracted position. In the extended position, at least a portion of the snap ring is received within the annular recess, and the outer tubular member is axially immovable relative to the inner tubular member. In the retracted position, no portion of the snap ring is received within the annular recess, and the outer tubular member is axially moveable relative to the inner tubular member.

In some embodiments, a well bore casing system includes a conductor system and an outer casing string disposed at least in part within the conductor system. The outer casing string includes an inner tubular member, a segmented landing ring supported on the conductor system, and a threaded landing ring rotatably coupled to the inner tubular. The segmented landing ring has a body and a plurality of segments disposed therein. Each segment is actuatable to extend at least in part from the body, whereby the segments form a shoulder. The threaded landing ring is moveable relative to the inner tubular to engage the shoulder.

In some method embodiments for installing an outer casing string, the method includes cementing a conductor in place within a borehole, positioning a diverter on the conductor, and lowering the outer casing string through the diverter, wherein the outer casing string includes a surface casing head assembly and an outer casing suspended there from.

Thus, embodiments described herein comprise a combination of features and characteristics intended to address various shortcomings associated with conventional surface casing heads and associated installation methods. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
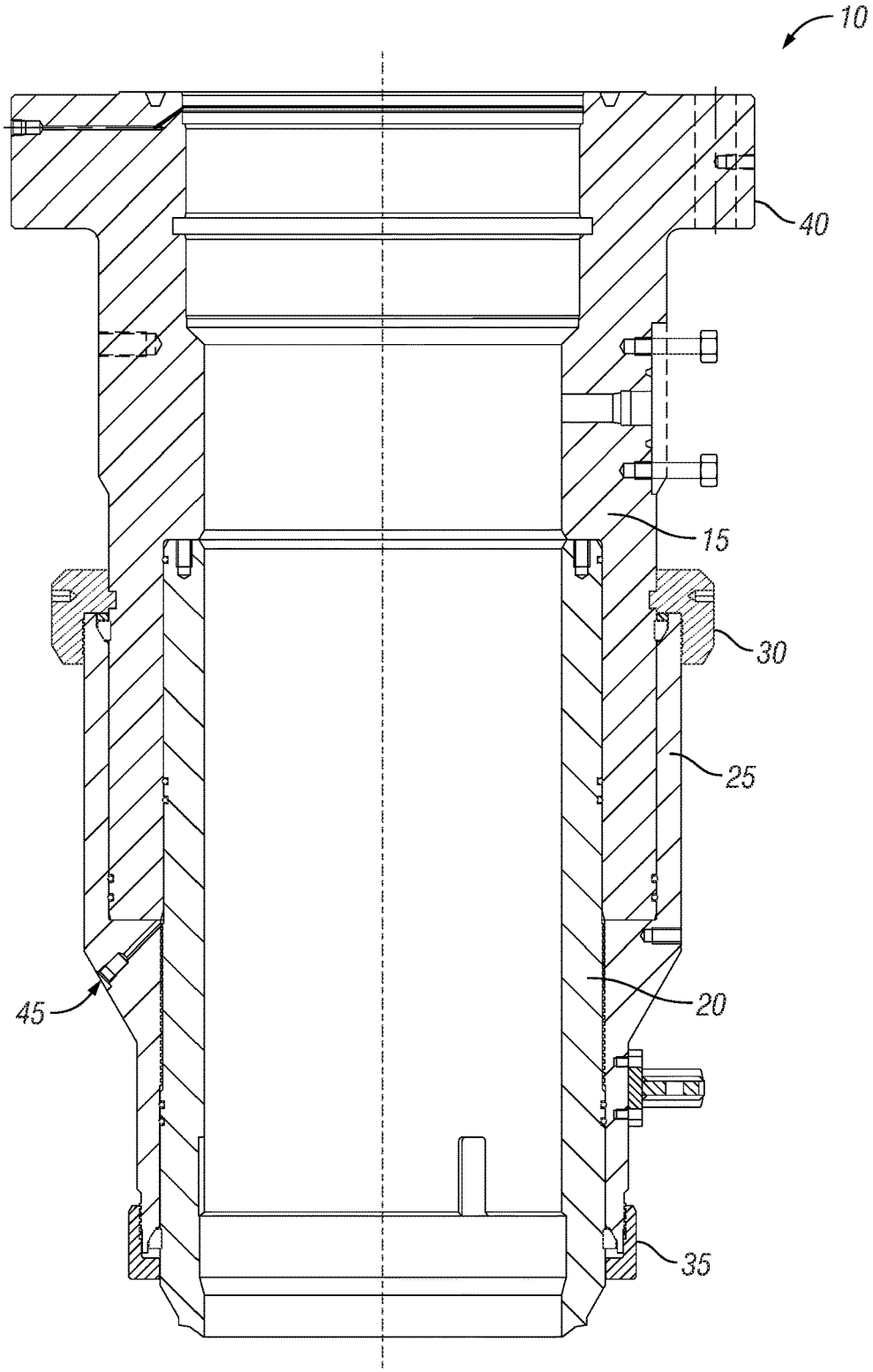
FIG. 1 (Prior Art)
FIG. 1 is a cross-sectional view of a conventional surface casing head.

The following description is directed to exemplary embodiments of a surface casing head and associated method of installation. The embodiments disclosed should not be interpreted, or otherwise used, as limiting the scope of the disclosure, including the claims. One skilled in the art will understand that the following description has broad application, and that the discussion is meant only to be exemplary of the described embodiment, and not intended to suggest that the scope of the disclosure, including the claims, is limited to that embodiment.

Certain terms are used throughout the following description and the claims to refer to particular features or components. As one skilled in the art will appreciate, different people may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis. The terms "radial" and "radially" generally mean perpendicular to the central or longitudinal axis, while the terms "circumferential" and "circumferentially" generally mean disposed about the circumference, and as such, perpendicular to both the central or longitudinal axis and a radial axis normal to the central or longitudinal axis. As used herein, these terms are consistent with their commonly understood meanings with regard to a cylindrical coordinate system.

Figure 2:
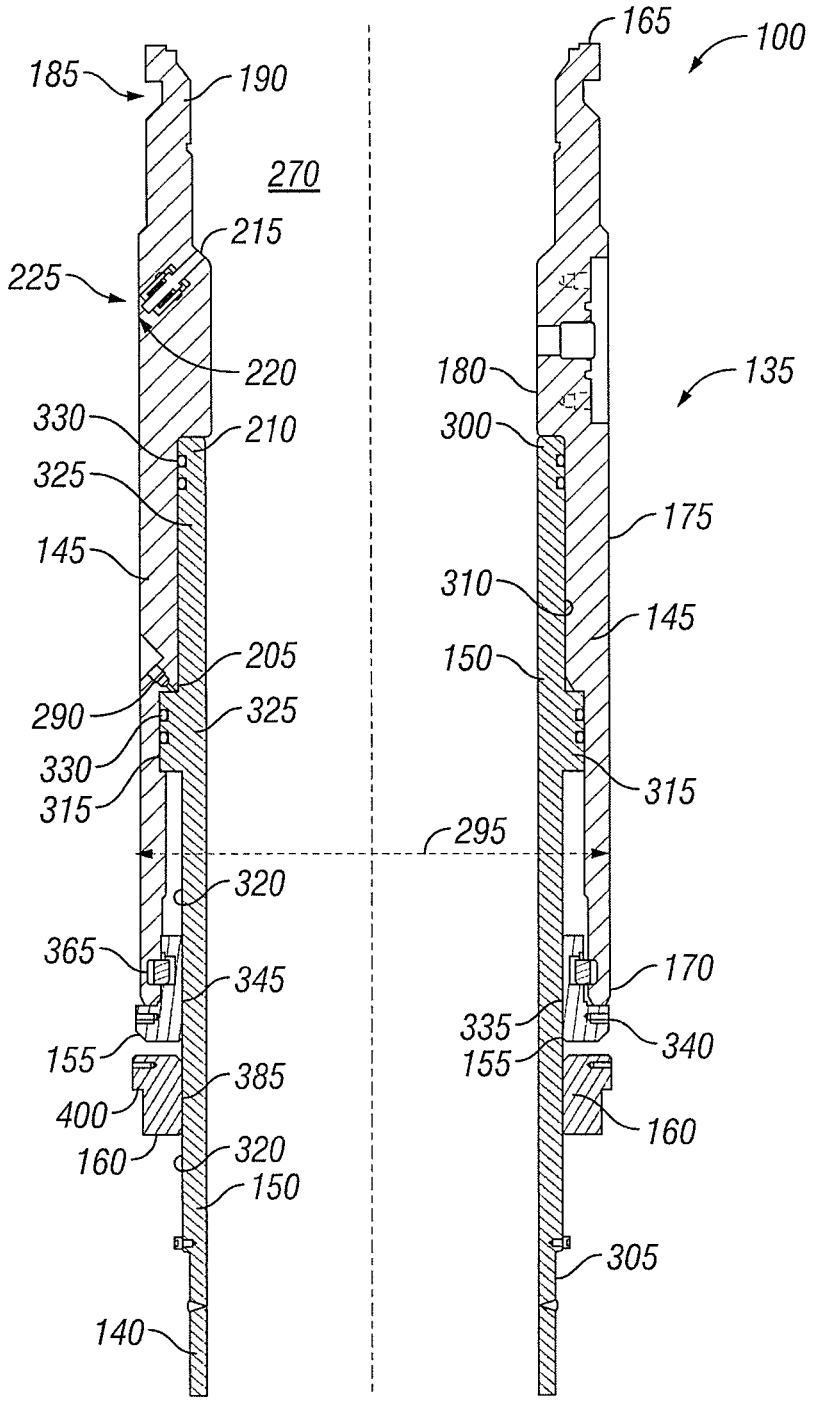
FIG. 2 is a cross-sectional view of an outer casing string, including a surface casing head in accordance with the principles disclosed herein.

Referring now to FIG. 2, there is shown an outer casing string having a surface casing head in accordance with the principles disclosed herein. Outer casing string 100 includes a surface casing head assembly 135, an outer casing 140 suspended there from, and a segmented landing ring (not shown). The segmented landing ring is run-in and installed separately from the remaining components of outer casing string 100 and will be described with reference to FIGS. 7, 8A, 8B, and 9. Surface casing head assembly 135, or simply surface casing head 135, has four primary components, namely a casing head body 145, an inner barrel 150, a sleeve ring 155, and a threaded landing ring 160.

Casing head body 145 is a tubular member with an upper end 165, a lower end 170, an outer surface 175 extending between ends 165, 170, and an inner surface 180, also extending between ends 165, 170. Outer surface 175 has a maximum diameter 295, discussed further below. Proximate upper end 165, casing head body 145 has an annular recess 185 formed in outer surface 175 and a plurality of threads 190 formed in inner surface 180. Outer annular recess 185 enables coupling of a blowout preventer (BOP) (not shown) to surface casing head assembly 135 after installation of outer casing string 100. Threads 190 enable releasable coupling of a surface casing running tool (also not shown) to casing head body 145, and thus outer casing string 100.

Figure 3:
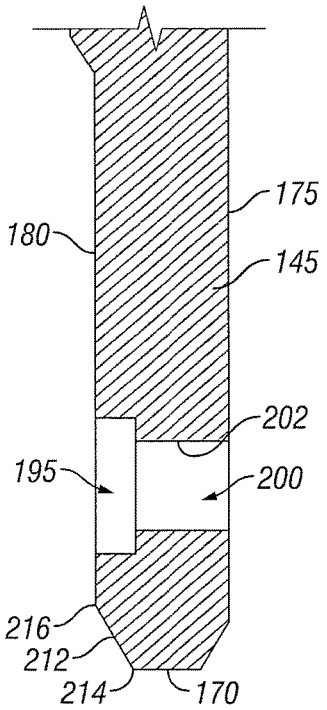
FIG. 3 is an enlarged, partial cross-sectional view of the casing head body of FIG. 2.

Proximate lower end 170, casing head body 145 has an annular recess 195, a plurality of circumferentially spaced through bores 200, and a chamfered end portion 212. Annular recess 195 and through bores 200 are best viewed in FIG. 3, which is an enlarged partial cross-sectional view of casing head body 145 proximate lower end 170. Annular recess 195 is formed in inner surface 180. Each through bore 200 is axially aligned with annular recess 195 and extends from outer surface 175 radially inward to annular recess 195. Also, each through bore 200 is bounded by a plurality of threads 202. Curved end portion 212 has a lower end 214 and an upper end 216 disposed axially upward of lower end 214. The diameter of casing head body 145 at lower end 214 exceeds the diameter of casing head body 145 at upper end and decreases in a smooth, continuous manner to its value at upper end 216. As will be described, inner annular recess 195, threaded through bores 200, and curved end portion 212 enable releasable coupling of sleeve ring 155 to casing head body 145.

Referring again to FIG. 2, casing head body 145 further includes three shoulders 205, 210, 215 formed along inner surface 180. During run-in, inner barrel 150 engages casing head body 145 at shoulders 205, 210. When a surface casing head running tool (see FIG. 9 and related description) is threaded into casing head body 145, engagement between shoulder 215 of casing head body 145 and the surface casing head running tool indicates these components are properly coupled. Later, after the surface casing head running tool is decoupled from outer casing string 100 and an intermediate casing string (also not shown) is installed within outer casing string 100, the intermediate casing string is supported by surface casing head assembly 135 at shoulder 215. As defined herein, the intermediate casing string includes an intermediate casing hanger and an intermediate casing suspended there from. The surface casing head running tool, the intermediate casing string, and their coupling with surface casing head assembly 135 will be shown and described below.

Casing head body 145 further includes a bore 220 extending between inner surface 180 at shoulder 215 and outer surface 175. An indicator pin 225 is inserted into bore 220. Indicator pin 225 provides a visual signal when the intermediate casing hanger has landed on and is supported by shoulder 215 of casing head body 145 during installation, as described below.

Figure 4:
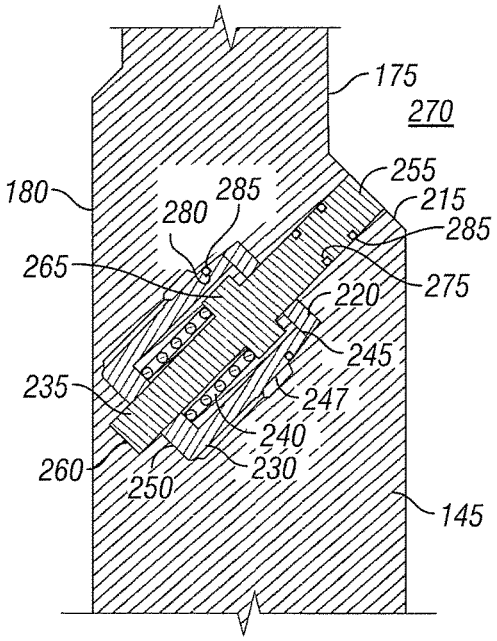
FIG. 4 is an enlarged, cross-sectional view of the indicator pin of FIG. 2.

In the illustrated embodiment, indicator pin 225 has a tubular housing 230, a pin member 235 extending there through, and a biasing member 240 disposed there between, all best viewed in FIG. 4. In some embodiments, biasing member 240 is a spring. Housing 230 is threadably connected within bore 220 to casing head body 145 and has a radially inner end 245, a radially outer end 250, and an outer surface 247 extending there between. Housing 230 further includes one or more annular grooves 280 formed in outer surface 247 and a sealing member 285 disposed in each groove 280. Sealing members 285 enable sealing engagement between housing 230 and casing head body 145. In some embodiments, sealing members 285 are O-rings.

Pin member 235 is displaceable within housing 230 between ends 245, 250. Further, pin member 235 has a radially inner end 255, a radially outer end 260, and a shoulder 265 disposed there between. Shoulder 265 limits movement of pin member 235 relative to housing 230 in either direction and prevents pin member 235 from disengaging housing 230. When pin member 235 is displaced within housing 230 and shoulder 265 engages inner end 245 of housing 230, inner end 255 of pin member 235 extends from housing 230 beyond shoulder 215 of casing head body 145 and into a through bore 270 of casing head body 145. In this position, outer end 260 of pin member 235 does not extend from housing 230 and thus pin member 235 is not visible. When pin member 235 is displaced within housing 230 in the opposite direction and shoulder 265 no longer engages inner end 245 of housing 230, outer end 260 of pin member 235 extends from housing 230 beyond outer surface 175 of casing head body 145. In this position, pin member 235 is visible.

Pin member 235 also includes one or more annular grooves 275 proximate inner end 255 and a sealing member 285 disposed in each groove 275. Sealing members 285 enable sealing engagement between pin member 235 and casing head body 145. In some embodiments, sealing members 285 are O-rings.

Biasing member 240 exerts force against shoulder 265 of pin member 235 such that pin member 235 is biased toward inner end 245 of housing 230 with shoulder 265 engaging inner end 245 and inner end 255 of pin member 235 extending beyond housing 230 and shoulder 215 of casing head body 145 into through bore 270. When a force is applied to inner end 255 of pin member 235 sufficient to overcome, or exceeding, the biasing force of member 240 on pin member 235, pin member 235 displaces within housing 230 and outer end 260 of pin member 235 extends from housing 230. When the applied force is subsequently removed, or reduced below the biasing force of member 240, biasing member 240 returns pin member 235 to a position of engagement inner end 245 of housing 230.

In some embodiments, biasing member 240 is configured such that its biasing force may not be overcome by forces less than those expected at shoulder 215 when the intermediate casing hanger is landed on surface casing head assembly 135. Consequently, when the intermediate casing hanger is landed on the shoulder 215 of surface casing head assembly 135, indicator pin 225 is actuated, meaning pin member 235 is displaced within housing 230 to extend outer end 260 of pin member 235 from housing 230 such that pin member 235 is visible. The visibility of pin member 235 indicates that the intermediate casing hanger is in the correct position relative to outer casing string 100. At the same time, other forces which may be applied to inner end 255 of pin member 235, for example, the pressure of fluid contained in through bore 270, will not be sufficient to actuate indicator pin 225 and provide a false indication that intermediate casing hanger is landed on the shoulder 215 of surface casing head assembly 135.

Referring again to FIG. 2, casing head body 145 further includes a port 290 extending between inner surface 180 proximate shoulder 205 and outer surface 175. Port 290 enables the injection of hydraulic fluid between casing head body 145 and inner barrel 150. As will be described, the introduction of hydraulic fluid between these components 145, 150 enables casing head body 145 to translate axially upward relative to inner barrel 150 to engage shoulder 215 of casing head body 145 with the intermediate casing hanger.

Inner barrel 150 is a tubular member coupled within casing head body 145. Inner barrel 150 has an upper end 300, a lower end 305, and an outer surface 310 extending there between. Lower end 305 is connected to outer casing 140, such as by welding, enabling outer casing 140 to be suspended from inner barrel 150 and thus surface casing head assembly 135. Inner barrel 150 further includes a radially-extending shoulder 315 and a plurality of threads 320 formed along outer surface 310 below shoulder 315. During run-in of outer casing string 100, upper end 300 and shoulder 315 of inner barrel 150 engage shoulders 205, 210, respectively, of casing head body 145, as shown. Threads 320 enable coupling of sleeve ring 155 and threaded landing ring 160 to inner barrel 150, as well as movement of sleeve ring 155 and threaded landing ring 160 relative to inner barrel 150 during installation of outer casing string 100 and the intermediate casing string.

Inner barrel 150 further includes a plurality of annular grooves 325 formed in outer surface 310 at shoulder 315 and proximate upper end 300 and a sealing member 330 disposed in each groove 325. Sealing members 330 enable sealing engagement between inner barrel 150 and casing head body 145. In some embodiments, sealing members 330 are O-rings. When hydraulic fluid is injected through port 290 of casing head body 145, as previously described, sealing members 330 limit, or prevent, leakage of the hydraulic fluid at these interfaces and enable pressure buildup between inner barrel 150 and casing head body 145. When the pressure of hydraulic fluid trapped between sealing members 330 reaches a sufficient level, casing head body 145 may translate axially upward relative to inner barrel 150 to engage the intermediate casing hanger.

Sleeve ring 155 is an annular body rotatably coupled about inner barrel 150 and releasably coupled to casing head body 145. Sleeve ring 155 has an inner surface 335 and an outer surface 340. A plurality of threads 345 are formed on inner surface 335. Threads 345 are adapted to engage threads 320 on outer surface 310 of inner barrel 150. Thus, sleeve ring 155 rotationally, or rotatably, couples to inner barrel 150 by engaging threads 320, 345. Further, rotation of sleeve ring 155 relative to inner barrel 150 enables axial movement of sleeve ring 155 along inner barrel 150. Movement of sleeve ring 155 in this manner enables releasable coupling of sleeve ring 155 to casing head body 145, as described below.

Figure 5C:
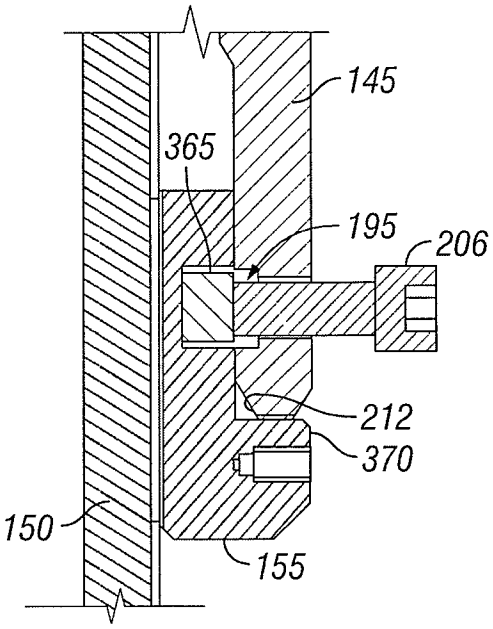
FIGS. 5A through 5C are enlarged, partial cross-sectional views of the sleeve ring of FIG. 2, illustrating releasable coupling of the sleeve ring with the casing head body.
Figure 5B:
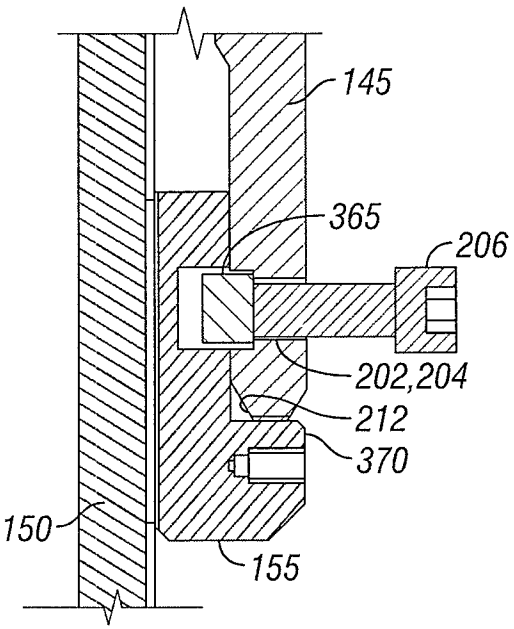
Figure 5A:
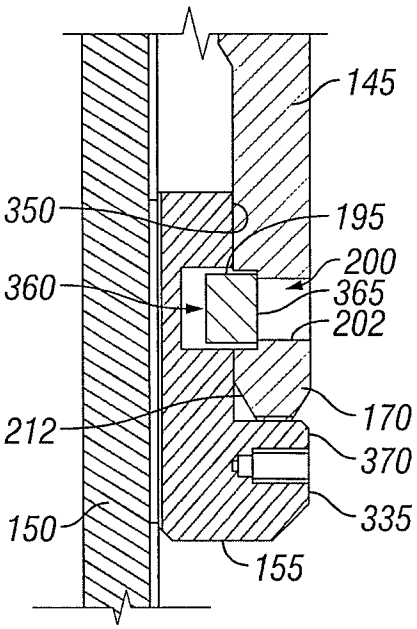

FIGS. 5A through 5C depict enlarged partial cross-sectional views of sleeve ring 155. As best viewed in FIGS. 5A through 5C, outer surface 340 of sleeve ring 155 includes an upper region 350 and a lower region 355. Upper region 350 is defined by a diameter that is less than a diameter defining lower region 355. Consequently, a shoulder 370 is formed at the transition between upper and lower regions 350, 355. An annular recess 360 is formed in upper region 350. Sleeve ring 155 further includes a head lock or snap ring 365 disposed in annular recess 360. Snap ring 365 is displaceable in the radial direction within annular recess 360 relative to sleeve ring 155 between an extended position (FIGS. 5A, 5B) and a retracted position (FIG. 5C). Further, snap ring 365 is spring-loaded such that it is biased toward the extended position.

Sleeve ring 155 may be releasably coupled to casing head body 145, as illustrated by FIG. 5A. To release, or disengage, sleeve ring 155 from casing head body 145, an actuating device 206, such as but not limited to a screw or bolt, is inserted into each through bore 200 of casing head body 145, as illustrated by FIG. 5B. The actuating device 206 has external threads 204 configured to mate with threads 202 of through bore 200. The actuating device 206 is then threaded into through bore 200 of casing head body 145 to engage snap ring 365 and force snap ring 365 to displace radially inward from the extended position to the retracted position, as illustrated by FIG. 5C.

Once in the retracted position, sleeve ring 155 may be rotated about inner barrel 150 and moved axially downward along inner barrel 150 until no portion of snap ring 365 remains axially aligned with annular recess 195 of casing head body 145 and is therefore unable to extend into recess 195. When snap ring 365 is in the retracted position and no longer aligned with recess 195 of casing head body 145, sleeve ring 155 is disengaged, or released, from casing head body 145. As such, casing head body 145 is free to move axially relative to inner barrel 150, such as during pressurization of the annular space between casing head body 145 and inner barrel 150 bounded by sealing elements 330 via injection of hydraulic fluid through port 290. Further downward axial movement of sleeve ring 155 relative to inner barrel 150 causes sleeve ring 155, in particular snap ring 365, to lose contact with casing head body 145, at which point snap ring 365 freely displaces from the retracted position to the extended position.

To again couple, or engage, sleeve ring 155 with casing head body 145, sleeve ring 155 is rotated about inner barrel 150 and moved axially along inner barrel 150. After snap ring 365 contacts curved end portion 212 of casing head body 145, further axial movement of sleeve ring 155 in the same direction causes gradual displacement of snap ring 365 from the extended position to the retracted position. When snap ring 365 aligns axially with annular recess 195 of casing head body 145, snap ring 365 again displaces from the retracted position to the extended position, interlocking sleeve ring 155 with casing head body 145. Further rotation of sleeve ring 155 loads shoulder 370 of sleeve ring 155 against lower end 170 of casing head body 145. When sleeve ring 155 is again coupled with casing head body 145 in this manner, casing head body 145 is prevented from moving relative to inner barrel 150, and structural load may be transferred between casing head body 145 and inner barrel 150. During running of the outer casing string, structural load is transferred between casing head body 145 and inner barrel 150 through snap ring 365. Once the intermediate casing hanger is landed and sleeve ring 155 is interlocked with casing head body 145, structural load is transferred between casing head body 145 and inner barrel 150 through sleeve ring 155.

Figure 6:
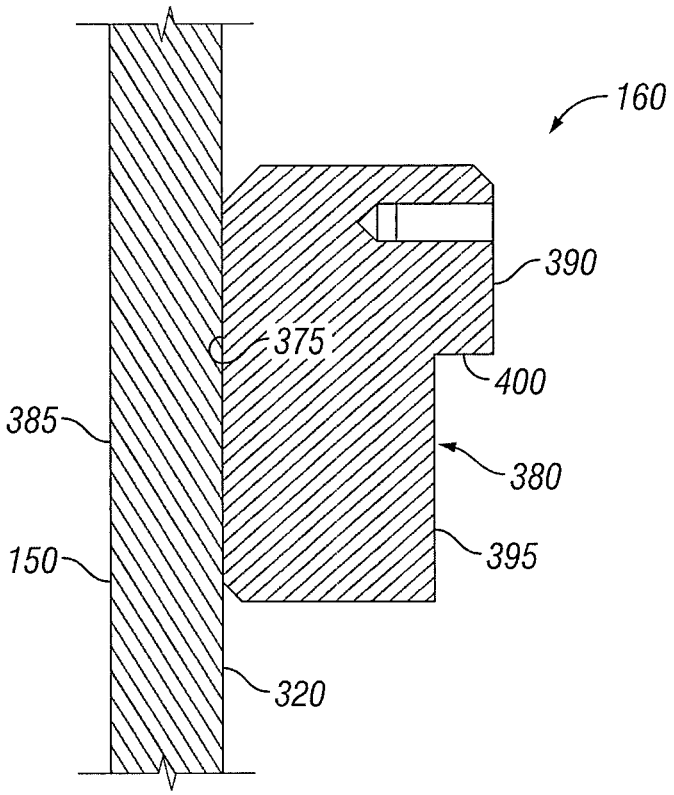
FIG. 6 is an enlarged, partial cross-sectional view of the threaded landing ring of FIG. 2.

Referring again briefly to FIG. 2, threaded landing ring 160 is an annular body rotatably coupled about inner barrel 150 and disposed axially below sleeve ring 155. FIG. 6 is an enlarged, partial cross-sectional view of threaded landing ring 160. As best viewed in FIG. 6, threaded landing ring 160 has an inner surface 375 and an outer surface 380. A plurality of threads 385 are formed on inner surface 375. Threads 385 are adapted to engage threads 320 on outer surface 310 of inner barrel 150. Thus, threaded landing ring 160 rotatably, or rotationally, couples to inner barrel 150 by engaging threads 320, 385. Further, rotation of threaded landing ring 160 relative to inner barrel 150 enables axial movement of threaded landing ring 160 along inner barrel 150.

Outer surface 380 of threaded landing ring 160 includes an upper region 390 and a lower region 395. Upper region 390 is defined by a diameter that is greater than a diameter defining lower region 395. Consequently, a shoulder 400 is formed at the transition between upper and lower regions 390, 395. As will be shown in and described with respect to FIG. 11, engagement between shoulder 400 and the segmented landing ring enables outer casing string 100 and the intermediate casing string suspended therein to be supported by an installed conductor.

Figure 7:
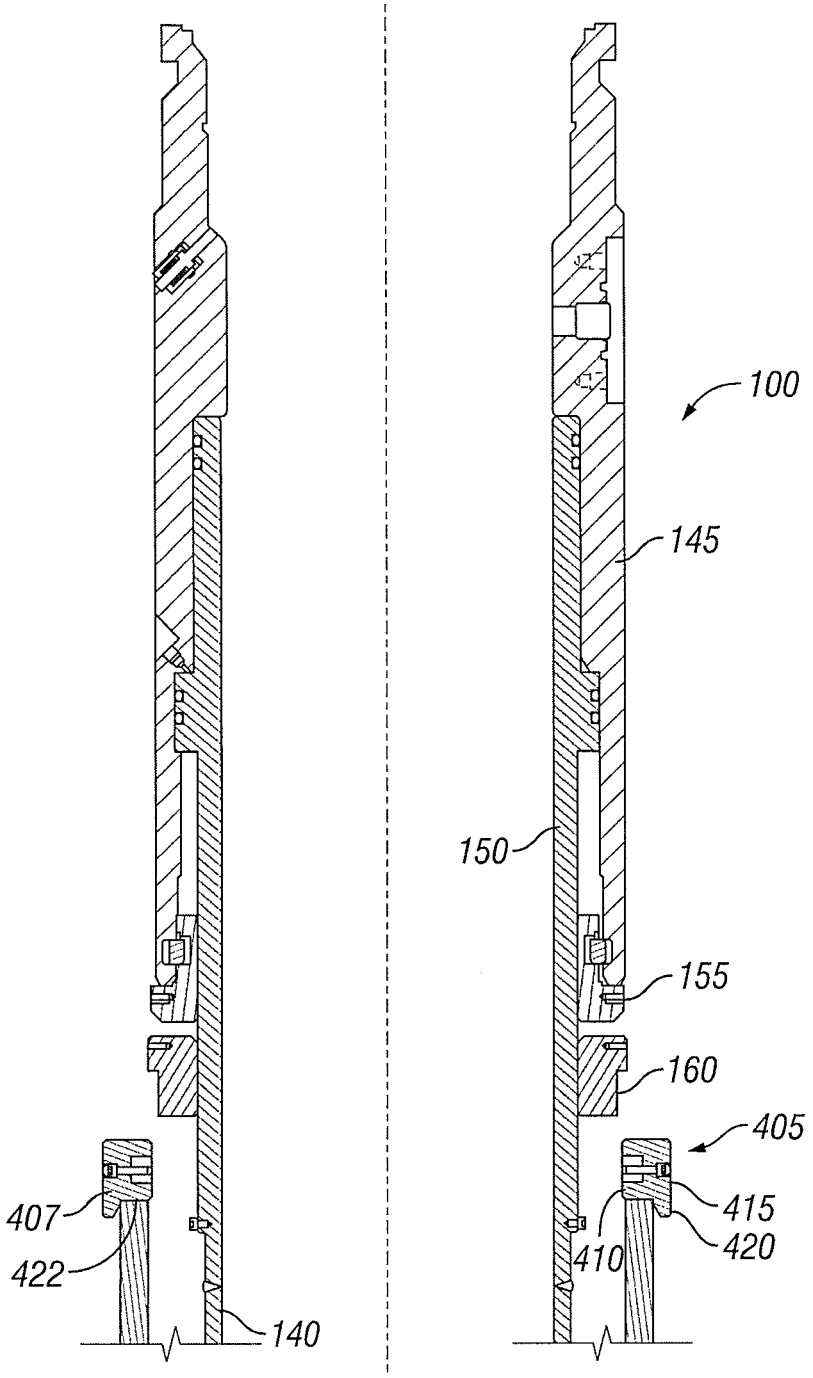
FIG. 7 is a cross-sectional view of the surface casing string of FIG. 2 with the segmented landing ring disposed thereabout.

As previously mentioned, outer casing string 100 includes a segmented landing ring 405 not shown in FIG. 2. Segmented landing ring 405 is run-in and installed separately from the above-described components of outer casing string 100. Turning to FIG. 7, segmented landing ring 405 is shown installed on a conductor. When installed, as shown, segmented landing ring 405 enables centralization of inner barrel 150 on the conductor and a tension load to be applied to the surface casing head assembly 135.

Segmented landing ring 405 is an annular body 407 with an inner surface 410, an outer surface 415, a flange 420, and an axially facing surface 422. Inner surface 410 is defined by a diameter that exceeds diameter 295 (FIG. 2) of casing body head 145. Thus, during installation of outer casing string 100, segmented landing ring 405 may be lowered about casing head body 145. Flange 420 extends both axially and circumferentially about the periphery of body 407, bounding axially facing surface 422. Surface 422 and flange 420 bound, or define, an annular recess 423. Segmented landing ring 405 is adapted to seat on the conductor such that axially facing surface 422 abuts the upper end of the conductor with the upper end received within annular recess 423. When seated within annular recess 423, flange 420 enables segmented landing ring 405 to remain in position.

Figure 8B:
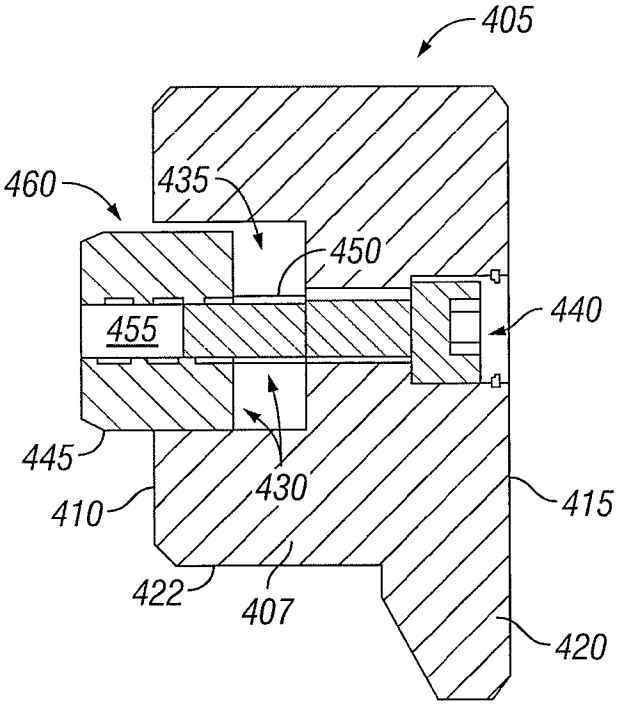
FIGS. 8A and 8B are enlarged, partial cross-sectional views of the segmented landing ring of FIG. 7, illustrating actuation of the segments disposed therein.
Figure 8A:
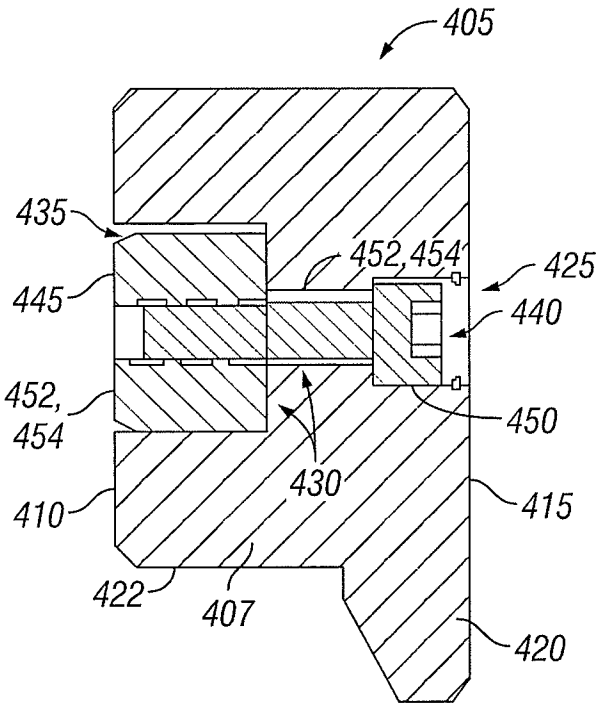

FIGS. 8A and 8B are enlarged partial cross-sectional views of segmented landing ring 405. As best viewed in FIGS. 8A and 8B, segmented landing ring 405 further includes a plurality of through passages 425 spaced circumferentially thereabout body 407 and an actuatable support assembly 430 disposed in each. Each through passage 425 extends between inner surface 410 and outer surface 415. Further, each through passage 425 has a recess 435 extending radially outward from inner surface 410 and a bore 440 extending radially inward from outer surface 415 to recess 435.

Each support assembly 430 includes a segment 445 and an actuating device 450, such as but not limited to a screw or bolt. The segment 445 is disposed in the recess 435. The actuating device 450 is disposed in the through passage bore 440 and extends radially inward from the bore 440 to engage the segment 445. The actuating device 450 is actuatable to extend the segment 445 at least in part from recess 435 of body 407 and to retract the segment 445 fully within the recess 435.

In the exemplary embodiment, the actuating device 450 has external threads 452 adapted to rotatably engage mating threads 454 bounding a radially extending bore 455 in the segment 445 and the through passage bore 440. As the actuating device 450 is rotated in one direction relative to body 407, engagement between the actuating device 450 and the segment 445 causes the segment 445 to displace radially inward relative to body 407 (to the left in FIGS. 8A, 8B). Continued rotation of the actuating device 450 in the same direction enables the segment 445 to extend, at least in part, from recess 435 of body 407, as shown in FIG. 8B. When the actuating device 450 is rotated in the opposite direction, the segment 445 is displaced radially outward relative to body 407 and toward the recess 435 (to the right in FIGS. 8A, 8B). Continued rotation of the actuating device 450 in the same direction causes the segment 445 to be retracted into the recess 435 of body 407, as shown in FIG. 8A.

When actuating devices 450 are actuated such that segments 445 are retracted fully within recesses 435 of body 407, segmented landing ring 405 may pass over casing head body 145, sleeve ring 155, and threaded landing ring 160, such as during installation of outer casing string 100. Conversely, when actuating devices 450 are actuated such that segments 445 are at least in part extended from recesses 435, segments 445 form a shoulder 460 extending radially from inner surface 410 of body 407. As will be shown and described, shoulder 460 of segmented landing ring 405 engages shoulder 400 of threaded landing ring 160 to support threaded landing ring 160 and other components coupled thereto after installation of outer casing string 100 is complete.

Figure 9:
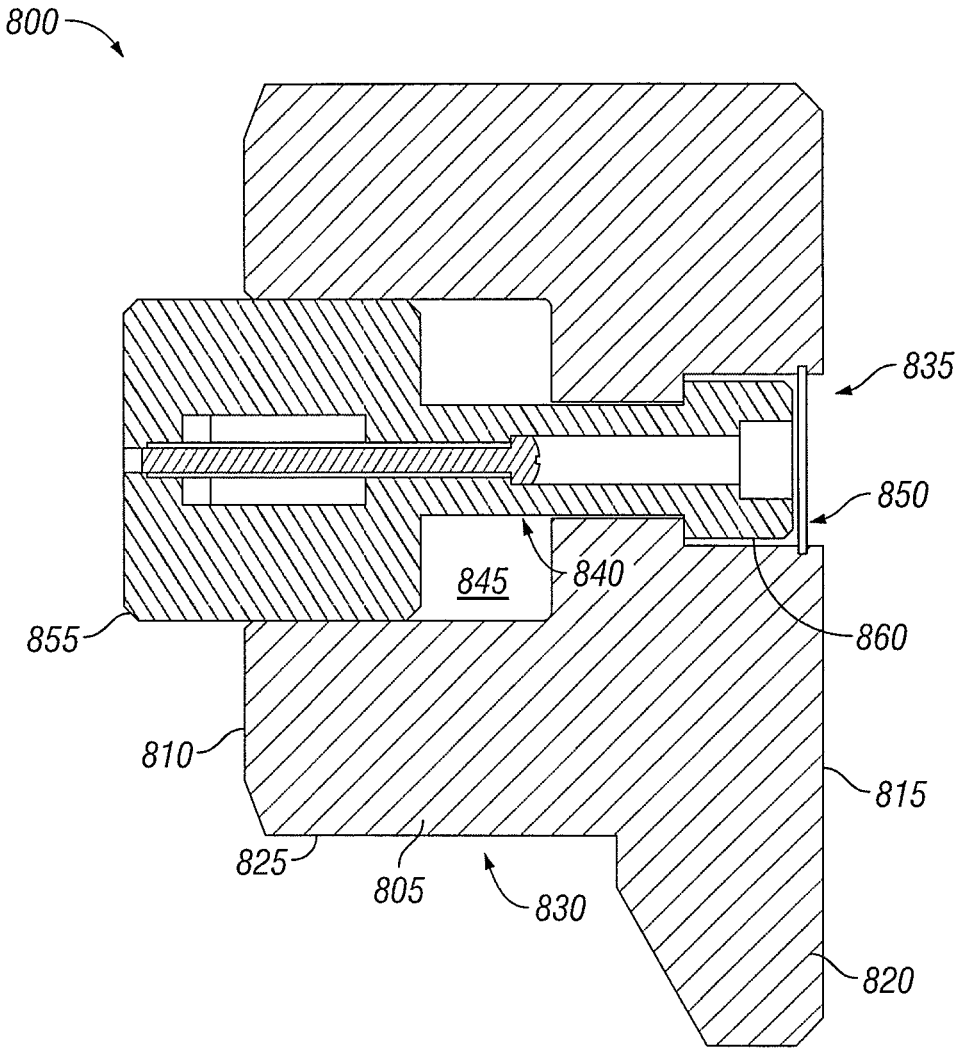
FIG. 9 is an enlarged, partial cross-sectional view of an alternative embodiment of a segmented landing ring.

FIG. 9 depicts an alternative embodiment of a segmented landing ring. Segmented landing ring 800 is similar in many respects to segmented landing ring 405, previously described. Segmented landing ring 800 has an annular body 805 with an inner surface 810, an outer surface 815, a flange 820, and an axially facing surface 825. Inner surface 810 is defined by a diameter that exceeds diameter 295 (FIG. 2) of casing body head 145. Thus, during installation of outer casing string 100, segmented landing ring 800 may be lowered about casing head body 145. Flange 820 extends both axially and circumferentially about the periphery of body 805, bounding axially facing surface 825. Surface 825 and flange 820 bound, or define, an annular recess 830. Segmented landing ring 800 is adapted to seat on the conductor such that axially facing surface 825 abuts the upper end of the conductor with the upper end received within annular recess 830. When seated within annular recess 830, flange 820 enables segmented landing ring 800 to remain in position.

Segmented landing ring 800 further includes a plurality of through passages 835 spaced circumferentially thereabout body 805 and an actuatable support assembly 840 disposed in each. Each through passage 835 extends between inner surface 810 and outer surface 815. Further, each through passage 835 has a recess 845 extending radially outward from inner surface 810 and a bore 850 extending radially inward from outer surface 815 to recess 845.

Each support assembly 840 includes a segment 855 and an actuating device 860, such as but not limited to a screw or bolt. The segment 855 is disposed in the recess 845. The actuating device 860 is disposed in the through passage bore 850 and extends radially inward from the bore 850 to engage the segment 855. The actuating device 860 is actuatable to extend the segment 855 at least in part from recess 845 of body 805 and to retract the segment 855 fully within the recess 845, similar to actuating device 450 of segmented landing ring 405, described above. In contrast to segmented landing ring 405, support assembly 840 of segmented landing ring 800 further includes a pin 865 coupled between segment 855 and actuating device 860. Pin 865 prevents segment 855 from completely disengaging body 805 when extended by actuating device 860.

Figure 10:
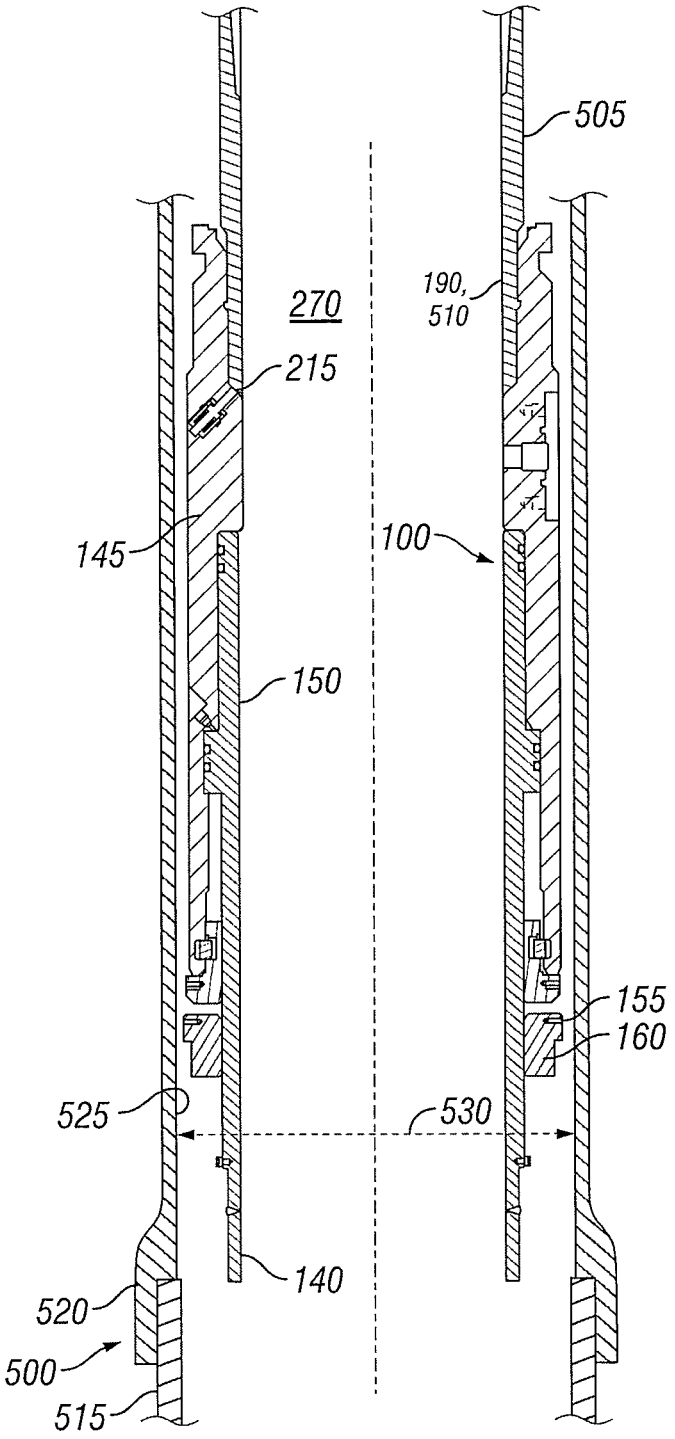
FIG. 10 is a cross-sectional view of the surface casing head installed within the diverter.

FIGS. 10 through 15 and related description illustrate an exemplary method for installing outer casing string 100. Referring initially to FIG. 10, outer casing string 100 is shown suspended by a surface casing head running tool 505 within an installed conductor system 500. Surface casing head running tool 505 includes a plurality of threads 510 disposed on its outer surface that rotatably engage threads 190 on casing head body 145, previously described. To couple surface casing head running tool 505 and outer casing string 100, running tool 505 is inserted into through bore 270 of casing head body 145 and rotated relative to casing head body 145 to couple threads 190, 510 until running tool 505 engages shoulder 215 of casing head body 145. When coupled, surface casing head running tool 505 enables run-in, as illustrated, and tensioning of outer casing string 100 when desired.

Conductor system 500 includes a conductor 515 and a diverter 520 supported thereon. Diverter 520 has an inner surface 525 defined by a diameter 530. Diameter 295 of casing head body 145 of casing head assembly 135, previously defined, is selected such that diameter 295 is less than inner diameter 530 of diverter 520. Therefore, in contrast to conventional casing head assemblies described above, casing head body 145 is insertable through diverter 120 and casing head assembly 135 may be run-in through diverter 120 during installation outer casing string 100, as illustrated. Diameter 295 of casing head body 145 is preferably selected such that fluid, for example, drilling mud, may pass between casing head body 145 and diverter 520. In some embodiments, diameter 295 of casing head body 145 is no greater than 26.50 inches, and diameter of 530 of diverter 520 is approximately equal to 28 inches.

Outer casing string 100 is run into conductor system 500 and landed at the mudline (not shown) by surface casing head running tool 505. After landing, outer casing 140 is cemented in position. Surface casing head running tool 505 is then rotated relative to outer casing string 100 to disengage threads 510 on running tool 505 from threads 190 of casing head body 145. Surface casing head running tool 505 and diverter 520 are then removed, leaving outer casing string 100 and conductor 515, as illustrated by FIG. 11.

Figure 11:
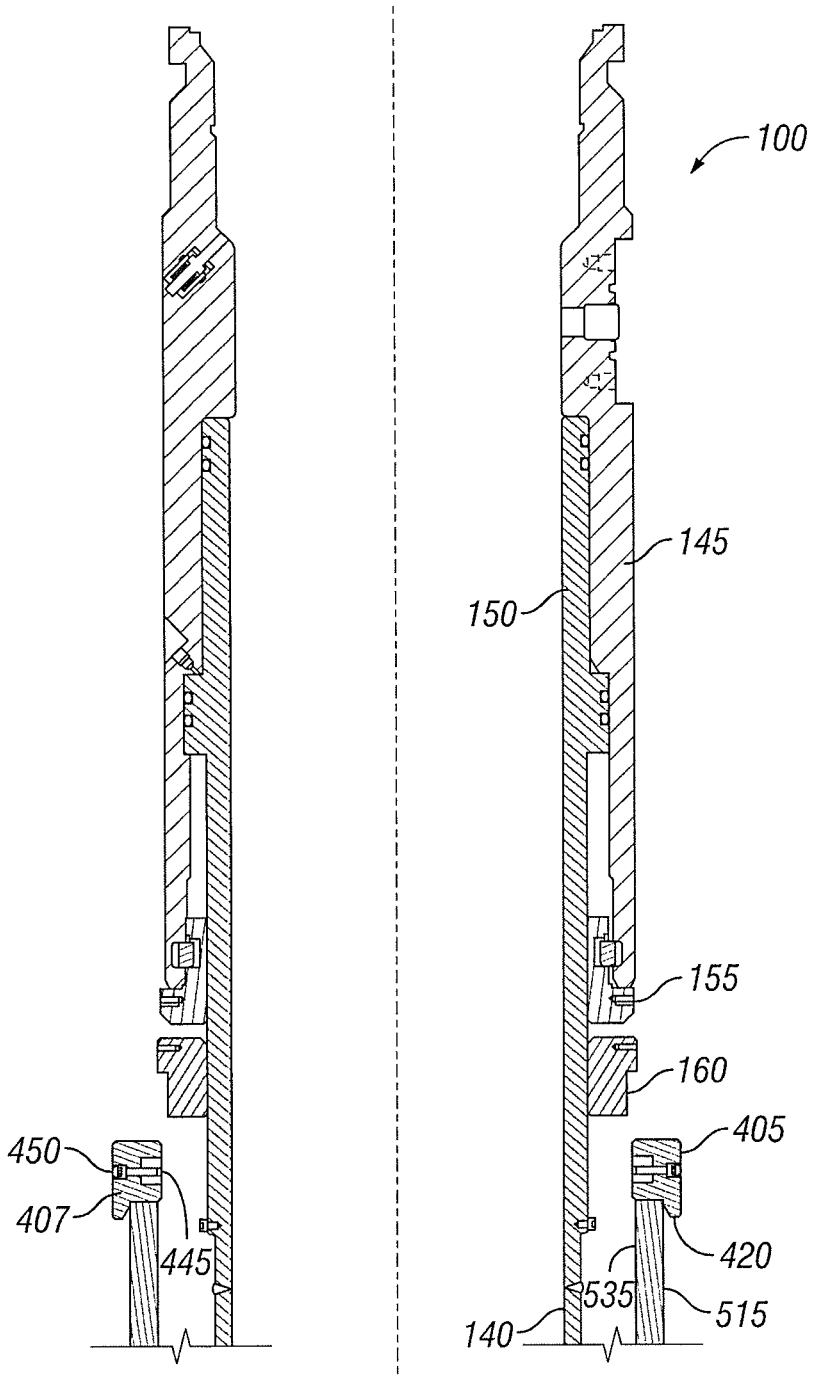
FIG. 11 is a cross-sectional view of the surface casing head of FIG. 10 and the segmented landing ring installed on the conductor.

Next, referring still to FIG. 11, segmented landing ring 405 is installed on conductor 515. If necessary, actuating devices 450 of segmented landing ring 405 are actuated to fully retract segments 445 within recesses 435 (FIGS. 8A, 8B) of body 407. In the above-described exemplary embodiment, actuating devices 450 are rotated to retract segments 445 into recesses 435. With segments 445 fully retracted within recesses 435 and having no portions extending radially from recesses 435, segmented landing ring 405 is lowered about surface casing head assembly 135 to seat on the upper end 535 of conductor 515, as shown. Once seated on conductor 515, axially extending flange 420 of segmented landing ring 405 enables ring 405 to remain positioned on end 535 of conductor 515. If desired, surface casing head running tool 505 may again be rotatably coupled to casing head body 145 and a tension load applied to outer casing string 100 by surface casing head running tool 505.

Figure 12:
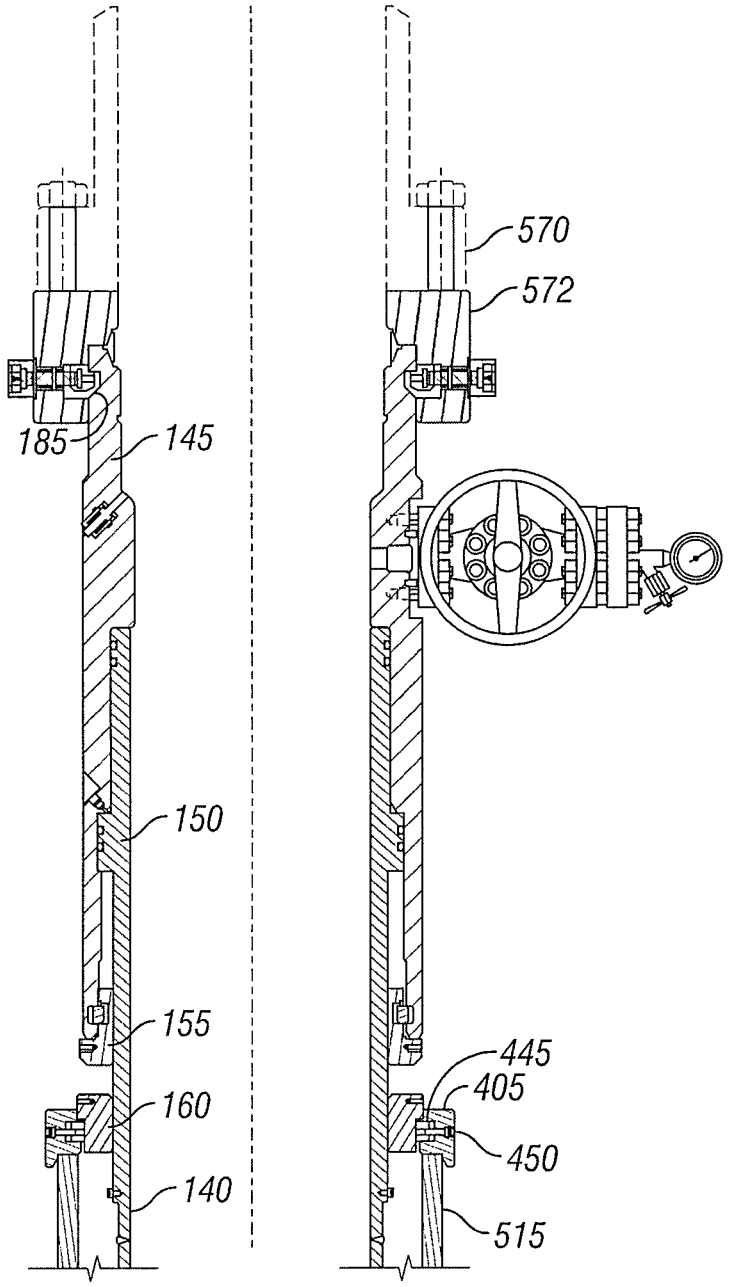
FIG. 12 is a cross-sectional view of the surface casing head of FIG. 11 with the threaded landing ring landed on the segmented landing ring.

Referring now to FIG. 12, subsequently to tensioning of outer casing string 100, if performed, actuating devices 450 of segmented landing ring 405 are actuated to extend segments 445 radially inward from recesses 435 (FIGS. 8A, 8B) of ring 405, thereby forming shoulder 460 (FIG. 8B). In the exemplary embodiment, actuating devices 450 are rotated to extend segments 445. Threaded landing ring 160 is then rotated relative to inner barrel 150 and moved axially downward to seat, or land, on shoulder 460 of segmented landing ring 405. Once engaged with threaded landing ring 160, segmented landing ring 405 enables centralization of inner barrel 150, surface casing string 140 suspended there from, and casing head body 145. Surface casing head running tool 505, if present, is again decoupled from outer casing string 100 and removed.

A BOP 570 is then installed at upper end 165 of casing head assembly 135. BOP 570 is coupled by a connector 572 within annulus recess 185 of casing head body 145. Connector 572, like flange 40 (FIG. 1) of conventional surface casing head 10, enables coupling of BOP 570 to outer casing string 100 and supports BOP 570 once installed thereon. However, unlike flange 40, which is integral to casing head body 15 (FIG. 1), connector 572 is not part of casing head body 145 and is installed separately from casing head body 145. This enables a slimmer configuration of casing head body 145, as compared to conventional casing head body 15. Consequently, casing head body 145 may be run-in through diverter 520, as previously described, whereas conventional casing head body 15 cannot.

Figure 13:
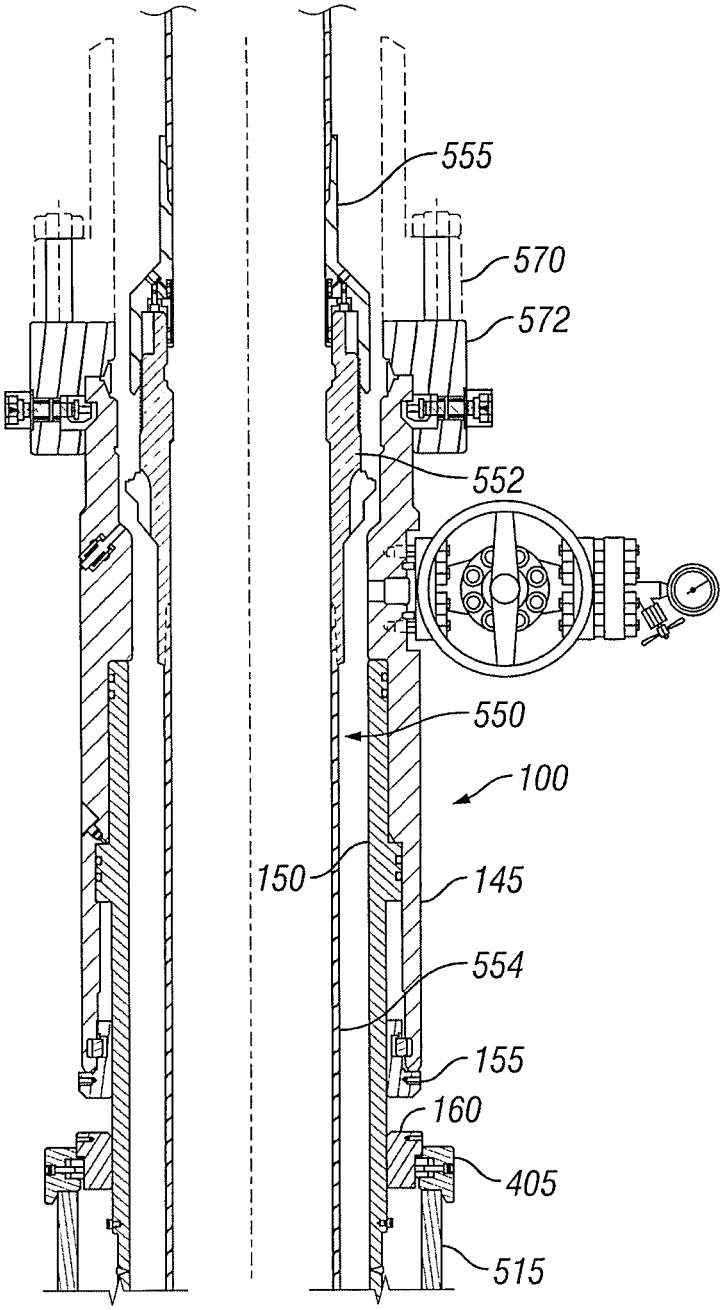
FIG. 13 is a cross-sectional view of the surface casing head of FIG. 12 with an intermediate casing system supported therein.

Turning to FIG. 13, an intermediate casing string 550 is lowered by an intermediate casing hanger running tool 555 into outer casing string 100 and landed at the mudline (not shown). Intermediate casing string 550 includes an intermediate casing hanger 552 and an intermediate casing 554 suspended there from. After intermediate casing string 550 is landed at the mudline, there remains axial clearance between intermediate casing hanger 552 and surface casing head assembly 135. In some embodiments, the clearance may be as high as eight inches. Intermediate casing 554 is then cemented in position. If desired, a tension load is applied by landing tool 555 to intermediate casing string 550.

Figure 14:
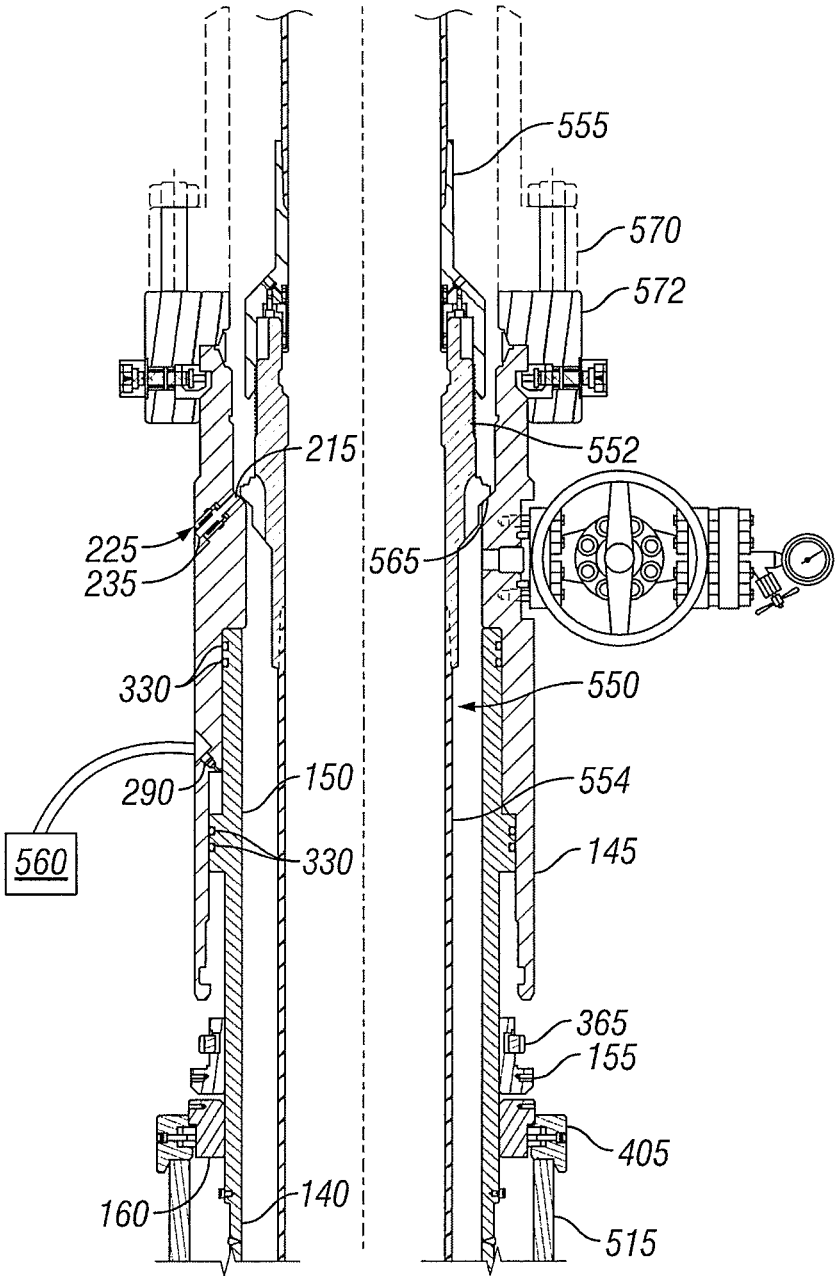
FIG. 14 is a cross-sectional view of the intermediate casing string landed on the surface casing head of FIG. 13.

Next, sleeve ring 155 is decoupled, or disengaged, from casing head body 145. Actuating devices 206 are inserted into through bores 200 of casing head body 145 and rotated relative to casing head body 145 and sleeve ring 155 of casing head assembly 135 to displace snap ring 365 from the extended position (FIG. 5B), disposed within annular recess 195 of casing head body 145, to the retracted position (FIG. 5C), disposed within annular recess 360 of sleeve ring 155. With snap ring 365 in the retracted position, sleeve ring 155 is then rotated relative to inner barrel 150 and moved axially downward along inner barrel 150 until no portion of snap ring 365 remains axially aligned with annular recess 195 of casing head body 145, as shown in FIG. 14. In this position, sleeve ring 155 is decoupled from casing head body 145. Thus, casing head body 145 is free to move axially upward relative to inner barrel 150.

Referring still to FIG. 14, after sleeve ring 155 is decoupled from casing head body 145, casing head body 145 is displaced axially to engage intermediate casing hanger 552. A source of pressurized hydraulic fluid 560, illustrated schematically, is coupled to port 290 of outer casing string 100. Hydraulic fluid is then injected through port 290 to the annular space between casing head body 145 and inner barrel 150 and bounded by sealing elements 330. The pressure of injected fluid acting on casing head body 145 causes casing head body 145 to displace axially upward relative to inner barrel 150 and engage shoulder 215 of casing head body 145 with a shoulder 565 of intermediate casing hanger 552. A significant increase, or spike, in hydraulic fluid pressure indicates shoulder 215 of casing head body 145 has contacted shoulder 565 of intermediate casing hanger 552.

Moreover, when shoulder 565 of intermediate casing hanger 552 is correctly landed on shoulder 215 of casing head body 145, pin indicator 225 is actuated to provide visual confirmation of their engagement. As shoulder 215 of casing head body 145 approaches shoulder 565 of intermediate casing hanger 552, contact and load from shoulder 565 with pin member 235 of pin indicator 225 causes pin member 235 to displace within housing 230 of pin indicator 225, thereby exposing outer end 260 of pin member 235 to view. Visibility of pin member 235 is confirmation that shoulder 565 of intermediate casing hanger 552 is correctly landed on shoulder 215 of casing head body 145.

Figure 15:
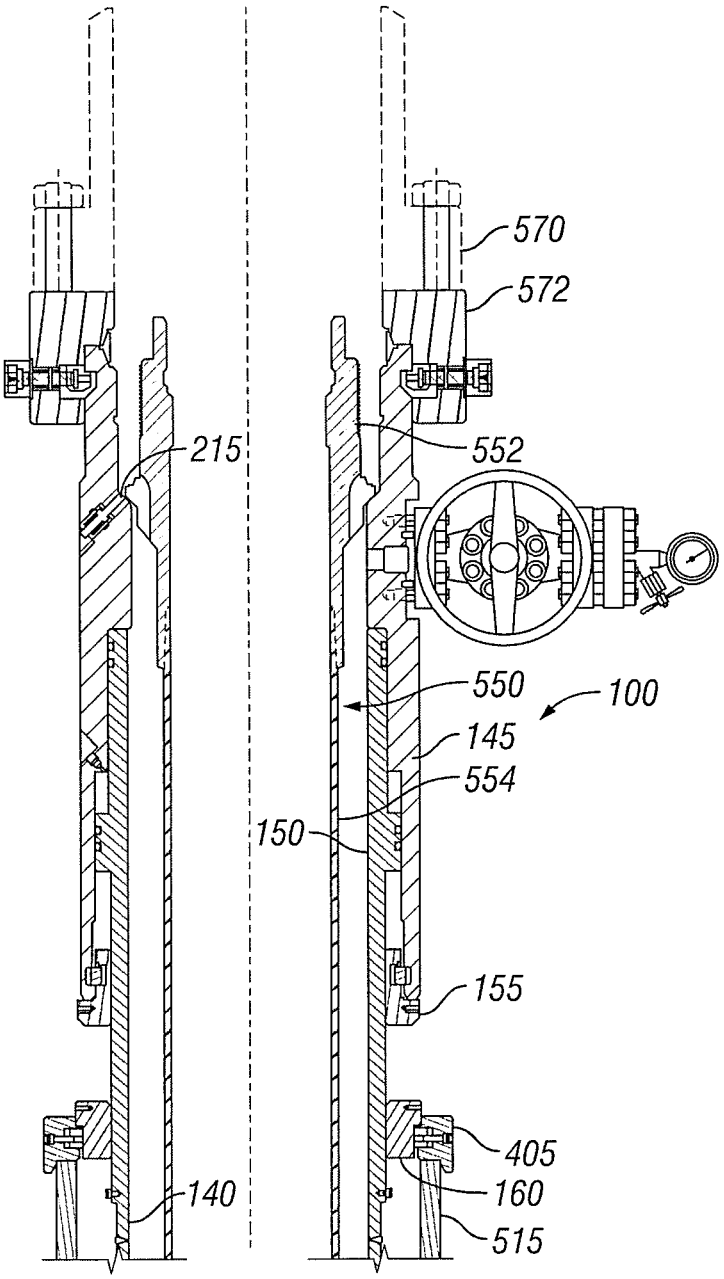
FIG. 15 is a cross-sectional view of the surface casing head and the intermediate casing string of FIG. 14 supported by the conductor.

With intermediate casing hanger 552 properly landed on casing head body 145, sleeve ring 155 is re-coupled to casing head body 145. Sleeve ring 155 is rotated relative to inner barrel 150 and moved axially upward toward casing head body 145. When snap ring 365 of sleeve ring 155 aligns axially with annular recess 195 of casing head body 145, snap ring 365 displaces radially outward into recess 195 to couple sleeve ring 150 with casing head body 145, as shown in FIG. 15.

Lastly, intermediate casing hanger running tool 555 is decoupled from intermediate casing string 550 and removed. Also, indicator pin 225, which is no longer required, may be replaced with a seal, such as but not limited a metal-to-metal seal. When intermediate casing landing tool 555 is decoupled from intermediate casing string 550, string 550 is in part supported within outer casing string 100 at shoulder 215 of casing head body 145 by outer casing string 100 and conductor system 500. The weight of intermediate casing string 550 at shoulder 215 is transferred from casing head body 145 through sleeve ring 155 to inner barrel 150. From inner barrel 150, the weight load is transferred through threaded landing ring 160 and segmented landing ring 405 to conductor system 500.

Embodiments of the disclosed outer casing string, including the surface casing head, may be run-in through a diverter for installation. This is in contrast to conventional outer casing strings, which include surface casing heads too large to pass through the diverter. In such cases, the diverter must be removed, the surface casing head then lowered within a conductor, and the string landed at the mudline. Consequently, installation of conventional outer casing strings requires multiple trips. Embodiments of the outer casing string disclosed herein require only a single trip for installation, and therefore offer significant time and cost savings, comparatively speaking.

Moreover, embodiments of the surface casing head disclosed herein may be lowered through a conventional rotary table. This is also in contrast to conventional surface casing heads, which are too large to pass through the rotary table and instead must be lowered over the side of a rig. Such installation methods are time consuming, and therefore costly, and pose increased risk to the safety of personnel involved.

Still further, embodiments of the surface casing head disclosed herein enable installation with reduced manual handling, as compared to that required for installation of conventional surface casing heads. For instance, conventional surface casing head 10, shown in FIG. 1, requires removal of packer nuts 30, 35, movement of lock sleeve 25, and subsequent replacement of packer nuts 30, 35 during installation, all of which are performed manually. Also, movement of lock sleeve 25 and replacement of packer nuts 30, 35 are performed after pressurization of surface casing head 10 and pose a safety risk to personnel involved. In contrast, installation of the embodiments of the surface casing head disclosed herein requires manual handling only during movement of the threaded landing ring and the sleeve ring. Even so, neither component is under load and may be easily moved with little risk to personnel.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A method for installing an outer casing string, the method comprising:

cementing a conductor in place within a borehole;

lowering the outer casing string at least partially in to the conductor, wherein the outer casing string comprises a surface casing head assembly and an outer casing suspended therefrom; and lowering an intermediate casing string into the outer casing string, wherein the intermediate casing string comprises an intermediate casing hanger and an intermediate casing suspended therefrom; and retracting a snap ring positioned between an annular recess in a casing head body of the surface casing head assembly and a sleeve ring disposed about an inner barrel disposed within the casing head body, rendering the casing head body axially moveable relative to the inner barrel.

2. The method of claim 1, further comprising:

injecting hydraulic fluid between the casing head body and the inner barrel; and moving the casing head body axially relative to the inner barrel to engage the intermediate casing hanger.

3. The method of claim 1, further comprising:

rotating the sleeve ring, whereby the snap ring aligns axially with the annular recess; and extending the snap ring into the annular recess, rendering the casing head body and the inner barrel axially immovable relative to one another.

4. The method of claim 1, further comprising extending an indicator pin beyond a shoulder on a casing head body of the surface casing head assembly.

5. The method of claim 4, wherein extending the indicator pin beyond the shoulder on the casing head body comprises:

engaging the indicator pin at the shoulder on the casing head body with the intermediate casing hanger; and extending the indicator pin beyond an outer surface of the casing head body when indicative of proper position of the casing head body relative to the intermediate casing hanger.

6. The method of claim 4, wherein the indicator pin is biased to not extend beyond the outer surface when any load applied thereto is less than a preselected value, the method further comprising applying a load above the preselected value to extend the indicator pin beyond the shoulder.

7. The method of claim 6, wherein the indicator pin comprises:

a housing disposed within the casing head body;

a pin member disposed within the housing and displaceable relative to the housing; and a biasing member disposed between the pin member and housing, the biasing member displacing biasing the pin member such that the pin member does not extend beyond the outer surface when any load applied to the pin member is less than the preselected value.

8. The method of claim 1, further comprising positioning a diverter on the conductor; and wherein the lowering the outer casing comprises lowering the outer casing string through the diverter.

9. The method of claim 8, further comprising:

landing the outer casing string at a mudline; and removing the diverter subsequent to the landing.

10. The method of claim 1, further comprising:

installing a landing ring on an end of the conductor; and landing the outer casing string on the landing ring.

11. The method of claim 10, wherein the landing ring comprises a segmented landing ring, the method further comprising:

actuating a plurality of segments disposed within a body of the segmented landing ring, whereby the segments extend radially beyond an inner surface of the body to form a shoulder; and rotating a threaded landing ring relative to an inner barrel of the surface casing head assembly to engage the shoulder and support the outer casing string.

12. A method for installing an outer casing string, the method comprising:

cementing a conductor in place within a borehole;

positioning a diverter on the conductor;

lowering the outer casing string through the diverter and at least partially in to the conductor, wherein the outer casing string comprises a surface casing head assembly and an outer casing suspended therefrom;

installing a segmented landing ring on an end of the conductor;

landing the outer casing string on the landing ring;

actuating a plurality of segments disposed within a body of the segmented landing ring, whereby the segments extend radially beyond an inner surface of the body to form a shoulder; and rotating a threaded landing ring relative to an inner barrel of the surface casing head assembly to engage the shoulder and support the outer casing string.

13. The method of claim 12, further comprising:

landing the outer casing string at a mudline; and removing the diverter subsequent to the landing.

14. The method of claim 12, further comprising:

lowering an intermediate casing string into the outer casing string, wherein the intermediate casing string comprises an intermediate casing hanger and an intermediate casing suspended therefrom; and retracting a snap ring positioned between a sleeve ring disposed about an inner barrel and an annular recess in a casing head body of the surface casing head assembly, rendering the casing head body axially moveable relative to the inner barrel disposed therein.

15. The method of claim 14, further comprising:

injecting hydraulic fluid into between the casing head body and the inner barrel; and moving the casing head body axially relative to the inner barrel to engage the intermediate casing hanger.

16. The method of claim 14, further comprising:

rotating a sleeve ring disposed about the inner barrel, whereby the snap ring aligns axially with the annular recess; and extending the snap ring into the annular recess, rendering the casing head body and the inner barrel axially immovable relative to one another.

17. The method of claim 14, further comprising:

engaging a pin member extending beyond a shoulder on the casing head body with the intermediate casing hanger; and displacing the pin member to extend beyond an outer surface of the casing head body when indicative of proper position of the casing head body relative to the intermediate casing hanger.

* * * * *